US006412999B1

(12) United States Patent
Pierpont

(10) Patent No.: US 6,412,999 B1
(45) Date of Patent: Jul. 2, 2002

(54) COSMETIC CONTAINER WITH PUSH-BACK PREVENTION FEATURE

(75) Inventor: Robert L. Pierpont, Meriden, CT (US)

(73) Assignee: Rexam Cosmetic Packaging, Torrington, CT (US)

( * ) Notice: Subject to any disclaimer, the term of this patent is extended or adjusted under 35 U.S.C. 154(b) by 0 days.

(21) Appl. No.: 09/798,154

(22) Filed: Mar. 2, 2001

(51) Int. Cl.[7] ..... A45D 40/04

(52) U.S. Cl. ..... 401/74; 401/68; 401/78; 401/80

(58) Field of Search ..... 401/74, 68, 78, 401/49, 80, 84

(56) References Cited

U.S. PATENT DOCUMENTS

| | | | | |
|---|---|---|---|---|
| 2,442,109 A | | 5/1948 | Anderson | |
| 3,515,493 A | | 6/1970 | Gruska | |
| 3,620,632 A | * | 11/1971 | Gruska | 401/78 |
| 4,311,402 A | | 1/1982 | Brown | |
| 4,792,251 A | | 12/1988 | Ryder | |
| 5,234,275 A | * | 8/1993 | Gueret | 401/78 |
| 5,302,042 A | | 4/1994 | Ackermann | |
| 5,324,126 A | | 6/1994 | Holloway et al. | |
| 5,636,930 A | | 6/1997 | Holloway | |
| 5,791,799 A | | 8/1998 | Oehlhorn | |
| 5,842,804 A | | 12/1998 | Hurlburt | |
| 5,899,621 A | | 5/1999 | Wang | |
| 6,036,387 A | | 3/2000 | Gueret | |

FOREIGN PATENT DOCUMENTS

| | | |
|---|---|---|
| GB | 1118889 | 7/1968 |

* cited by examiner

*Primary Examiner*—Gregory Huson
*Assistant Examiner*—Huyen Le
(74) *Attorney, Agent, or Firm*—Alston & Bird LLT

(57) ABSTRACT

A cosmetic container is provided which has a smoothly operating mechanism with low swivel torque, and which avoids unwanted push-back. The container comprises an inner first tubular sleeve, a cosmetic carrier positioned for movement longitudinally within the first tubular sleeve between an extended upper position and a retracted lower position, and a second tubular sleeve surrounding the first sleeve and rotatable with respect to the first sleeve. The second sleeve has a helical channel extending along an inner periphery of the sleeve for extending and retracting the cosmetic carrier upon rotation of the first sleeve within the second sleeve. A cylindrical skirt on a lower end of the second sleeve extends below the helical channel surrounding a portion of the inner first tubular sleeve. One or more protrusions project outwardly from the cylindrical sidewall of the first sleeve. The cylindrical skirt on the second sleeve is thus positioned for frictional engagement with the protrusions to create a braking force against unwanted retracting movement of the cosmetic carrier when a downward axial force is applied to the cosmetic carrier.

17 Claims, 5 Drawing Sheets

COSMETIC CONTAINER WITH PUSH-BACK PREVENTION FEATURE

FIELD OF THE INVENTION

The present invention is directed to a container for application of cosmetics in the form of sticks, such as lipsticks, for example, and more particularly relates to a cosmetic container designed for preventing unwanted retracting movement of the cosmetic during application.

BACKGROUND OF THE INVENTION

Conventional containers for stick form cosmetics, such as lipsticks and the like, include a cosmetic carrier positioned in an inner tubular sleeve, and a second tubular sleeve surrounding the inner sleeve. Upon rotation of the sleeves, the cosmetic carrier can be moved from a retracted lower storage position to an extended upper position for application of the cosmetic.

In the manufacture of containers of this type, an important design criteria is to provide a cosmetic container having a smoothly rotating movement and which allows for extending and retracting the cosmetic carrier with relatively low swivel torque. However, the reduced swivel torque allows the cosmetic carrier to more readily slide downward under the influence of a downward axial force, such as when the cosmetic is being applied, causing unwanted retraction of the cosmetic into the container. This is referred to as "push-back". Push-back has been an undesirable side effect of providing a smoothly operating cosmetic container having a low swivel torque requirement to extend and retract the lipstick.

Commonly owned U.S. Pat. No. 5,842,804 provides one solution to the problem of unwanted push-back. It is an object of the present invention to provide a further way for preventing unwanted push-back, which can be used independently or in combination with the approach described in the aforementioned patent.

SUMMARY OF THE INVENTION

The present invention provides a cosmetic container which has a smoothly operating mechanism with low swivel torque, and which avoids unwanted push-back.

The cosmetic container comprises an inner first tubular sleeve, a cosmetic carrier positioned for movement longitudinally within the first tubular sleeve between an extended upper position and a retracted lower position, and a second tubular sleeve surrounding the first sleeve and rotatable with respect to the first sleeve. The second sleeve has a helical channel extending along an inner periphery of the sleeve for extending and retracting the cosmetic carrier upon rotation of the first sleeve within the second sleeve. A cylindrical skirt on a lower end of the second sleeve extends below the helical channel surrounding a portion of the inner first tubular sleeve. One or more protrusions project outwardly from the cylindrical sidewall of the first sleeve. The cylindrical skirt on the second sleeve is thus positioned for frictional engagement with the protrusions to create a braking force against unwanted retracting movement of the cosmetic carrier when a downward axial force is applied to the cosmetic carrier.

In a specific preferred embodiment, each protrusion has a wedge-shaped configuration defining an inclined ramp surface positioned to frictionally engage a lower portion of the skirt. When a downward axial force is applied to the cosmetic, such as during application of the cosmetic, the force is transmitted from the cosmetic carrier to the second sleeve causing the lower portion of the cylindrical skirt to bear against the ramp surface of the wedge-shaped protrusions, thereby retarding relative rotation between the first and second sleeves.

BRIEF DESCRIPTION OF THE DRAWINGS

The foregoing and other objects, features, and advantages of the present invention will become apparent from the following detailed description of a specific embodiment of the invention, and from the accompanying drawings, in which.

DETAILED DESCRIPTION OF THE INVENTION

The present invention will now be described more fully with reference to the accompanying drawings, in which a preferred embodiment of the invention is shown. This invention should not, however, be construed as limited to the embodiment set forth herein; rather, this specific embodiment is provided so that this disclosure will be through and complete and will fully convey the scope of the invention to those skilled in the art.

The present invention is shown and described herein as a container for applying lipstick. For the sake of brevity, the description which follows will refer to a lipstick container. However, it should be understood that the container can be used for various other purposes and with other kinds of cosmetics supplied in stick form, and that the invention is therefore not restricted to the specific application shown.

Figure 1:
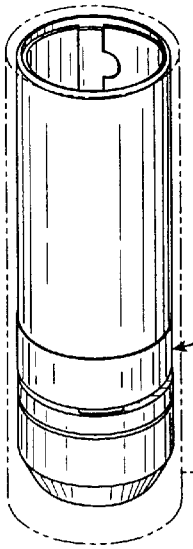
FIG. 1 is a perspective view of a cosmetic container according to the present invention.
Figure 2:
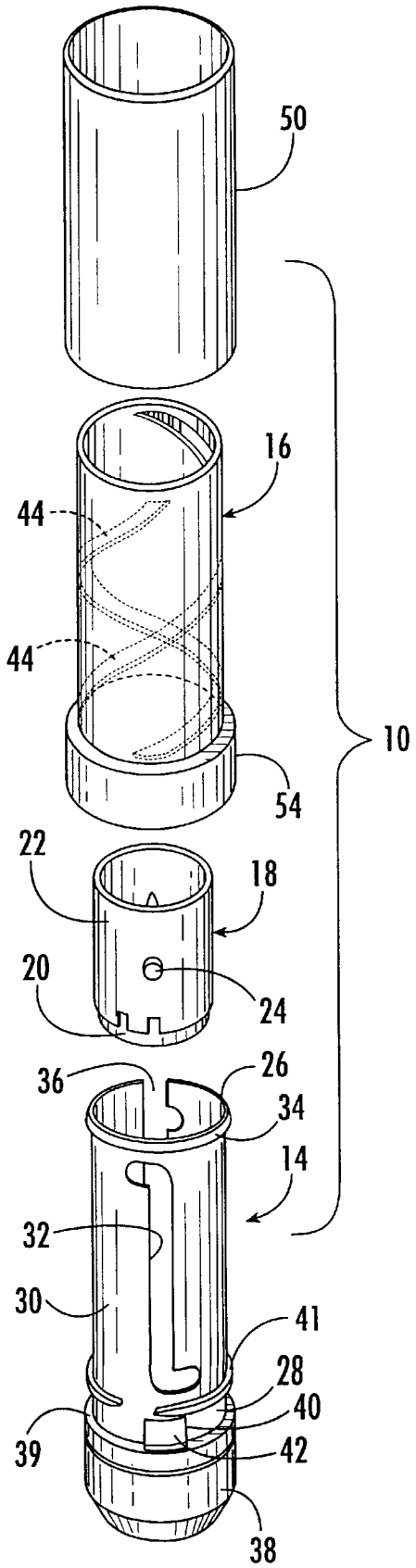
FIG. 2 is an exploded view of the cosmetic container of FIG. 1.
Figure 3:
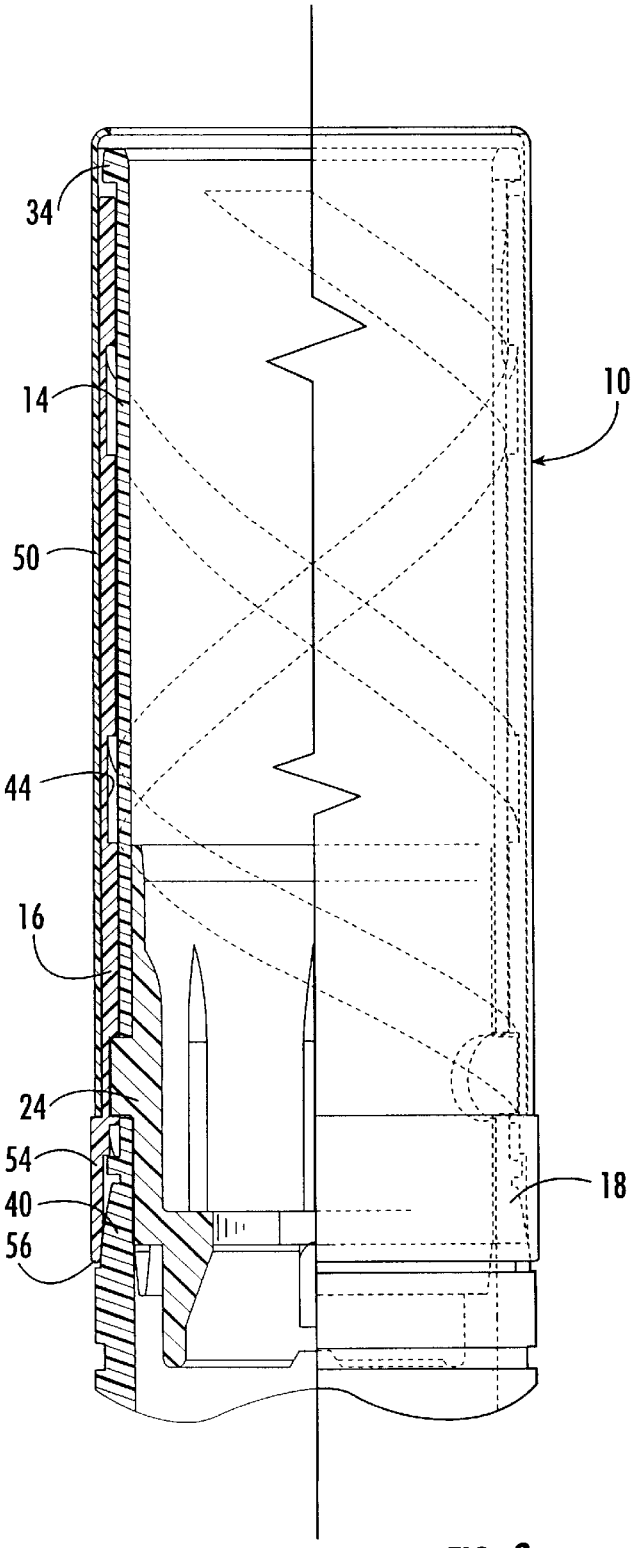
FIG. 3 is a partial cross-sectional view of the cosmetic container of FIG. 1.
Figure 4:
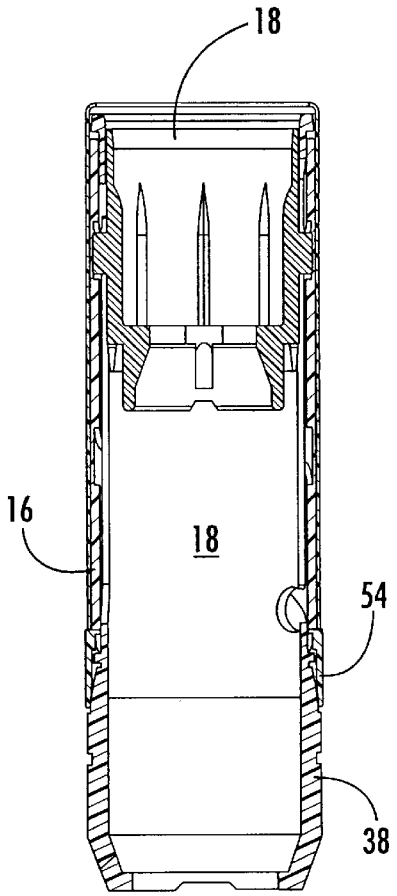
FIG. 4 is a cross-sectional view similar to FIG. 3 with the cosmetic carrier in the extended position.

The lipstick container of the present invention is indicated by the reference character 10. An outer enclosure 12, shown in phantom, may also be provided as a protective closure for the lipstick container 10. As best seen in FIG. 2, the lipstick container 10 includes an inner tubular first sleeve 14 and a surrounding tubular second sleeve 16 which are concentrically arranged about the longitudinal axis. A cosmetic carrier 18 is positioned within the first sleeve 14 and is moveable longitudinally upwardly or downwardly within the inner first sleeve 14. The cosmetic container carrier 18 includes a base 20 and a cylindrical sidewall 22 extending upwardly from the base to define a cup for receiving and holding the lipstick. The cosmetic carrier 18 also includes a pair of lugs 24, located on diametrically opposite outer surfaces of the cylindrical sidewall 22. Although the lugs 24, as shown, are provided as a pair and are diametrically opposed, it would not be a departure from the present invention to provide a different number of lugs on the cosmetic carrier 18.

Figure 8:
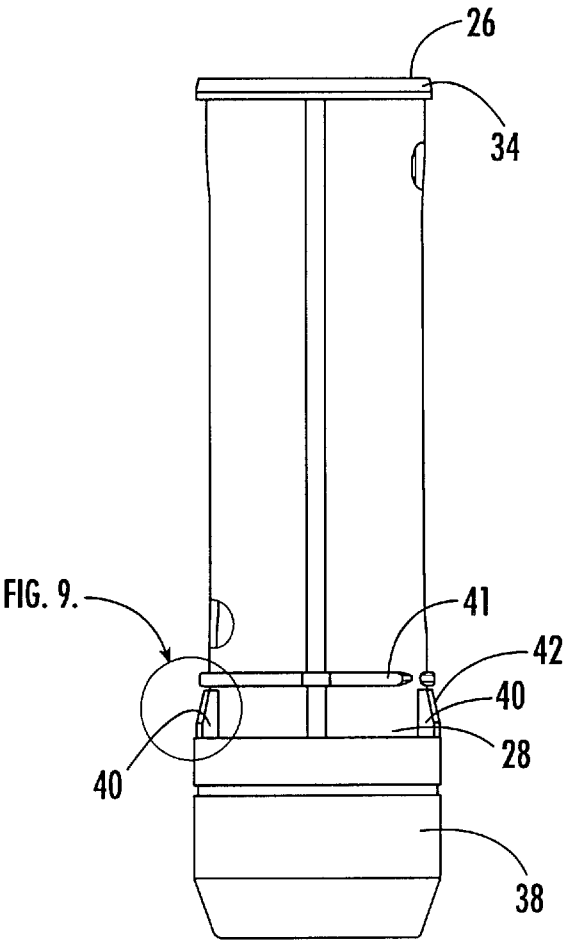
FIGS. 7 and 8 are front and side elevational views, respectively, showing the inner sleeve.
Figure 7:
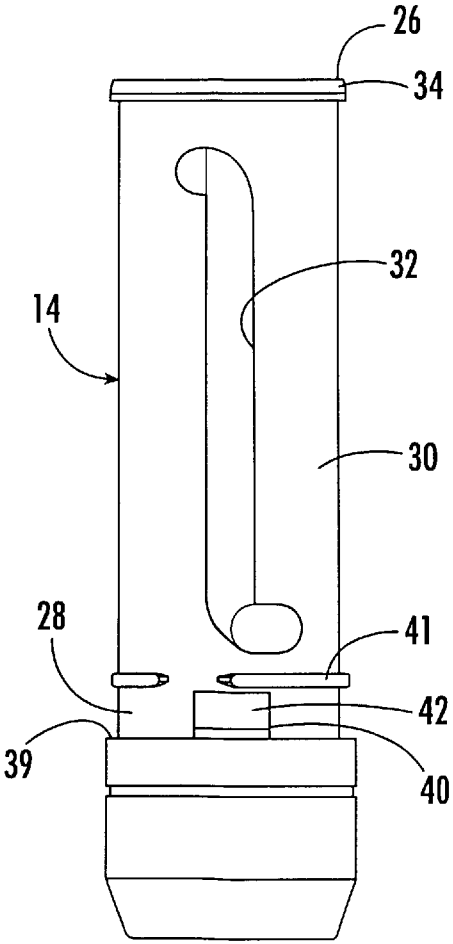

The tubular inner first sleeve 14 is best shown in FIGS. 2, 7 and 8. The tubular sleeve 14 has an upper end 26, a lower end 28, and a cylindrical sidewall 30 extending between the upper and lower ends. A pair of longitudinally extending slots 32 are formed in the cylindrical sidewall at diametrically opposed locations. The lugs 24 of the cosmetic carrier 18 extend through the longitudinal slots 32 of sleeve 14. At the upper end 26 of the cylindrical sidewall, there is provided an enlarged circumferentially extending flange portion 34, which cooperates with the tubular second sleeve 16, described more fully below, to retain the inner first sleeve 14 in assembled relation with the second sleeve 16. An opening 36 interrupts the circumferential extent of the flange portion 34 and joins with one of the slots 30. This permits the upper flange portion 34 to be resiliently deformable to facilitate assembly with the second sleeve 16.

Figure 9:
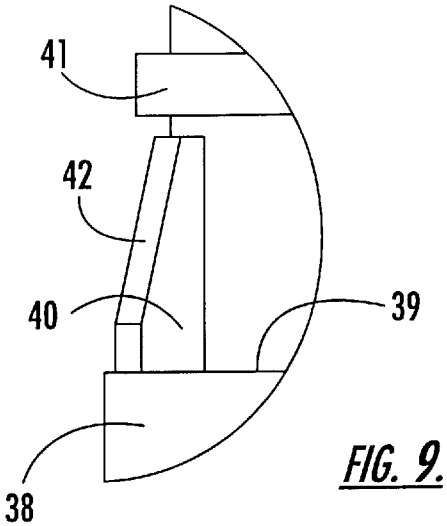
FIG. 9 is a fragmentary detail view of the portion indicated at "FIG. 9" in FIG. 8 and showing a protrusion at an enlarged scale.

Adjoining the lower end 20 of the cylindrical sidewall of sleeve 14 is a manually rotatable base 38. Preferably, the base 38 is formed integrally with the cylindrical sidewall of sleeve 14, and as shown it is of a slightly larger diameter than the diameter of the cylindrical sidewall 30. Thus at the juncture between the cylindrical sidewall 30 and the larger diameter base 38, a radially extending flange surface 39 is formed. As best seen in FIGS. 2, 7, 8 and 9, a plurality of protrusions 40 project outwardly from the cylindrical sidewall adjacent the lower end 28 of the sleeve 14. The protrusions, more particularly, are in the shape of a wedge and form an inclined ramp surface 42. Preferably, this ramp surface forms an acute angle of from about 10° to about 14° with respect to the longitudinal axis of the sleeve 14. The wedge formations are integrally formed with the sidewall 30 and with the base 38. Preferably, the wedge formations are two in number and are spaced apart from one another on diametrically opposite sides of the sidewall 30. As seen in FIG. 9, the wedge formation increases in height (radial extent) as it approaches the flange surface 39. However, the maximum outward radial extent of the wedge formation is less than the outward extent of the base portion 38.

A tubular second sleeve 16 circumferentially surrounds the inner first sleeve 14. The second sleeve 16 has a pair of opposed helical channels 44 formed on the inner surface of the sleeve. The helical channels 44 are defined by opposing upper and lower sidewalls and a bottom wall. The channels 44 thus receive the respective lugs 24 on the cosmetic carrier 18. The second sleeve 16 is retained in assembled relation surrounding the inner first sleeve 14 by the flange portion 34, which engages the uppermost edge of the second sleeve 16 and limits its upward movement. A circumferentially extending segmental bead 41 is formed in a lower portion of the sidewall 30 of inner sleeve 14 a short distance above the protrusions 40. This bead provides support for the inner surface of the second sleeve 16 at its lower end and also serves to limit downward movement of the second sleeve 16 relative to the inner first sleeve 14.

In the illustrated embodiment, the cosmetic container includes an optional outer decorative sleeve 50 which surrounds the second sleeve 16. In an alternative embodiment, the outer decorative sleeve may be omitted, and the outer surface of the sleeve 16 may be provided with a decorative surface appearance. In still another embodiment, the tubular outer sleeve 50 and the second sleeve 16 may be formed in such a way that the helical channels 44 are defined by helical slots in the sleeve 16, with the inner surface of the outer sleeve 50 forming the bottom wall of the helical channel. These and other variations known in the art can be utilized and are not a limiting feature of the present invention.

The above-described components of the cosmetic container allow for the carrier 18, and the lipstick or other cosmetic carried thereby, to be moved from a retracted lowered position to an extended upper position with the lipstick exposed for application. This is achieved by rotating the base 38 while holding the second sleeve 16 or outermost sleeve 50 stationary.

Figure 5B:
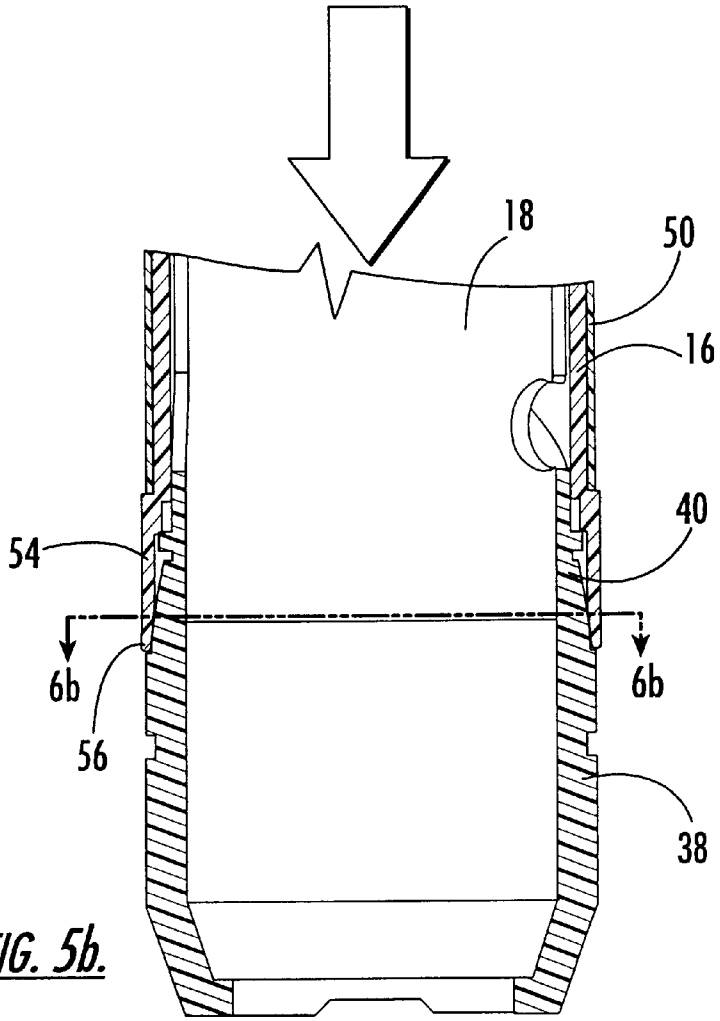
FIGS. 5*a* and 5*b* are partial cross-sectional views of the container in the relaxed state and as axial pressure is applied thereto, respectively.
Figure 5A:
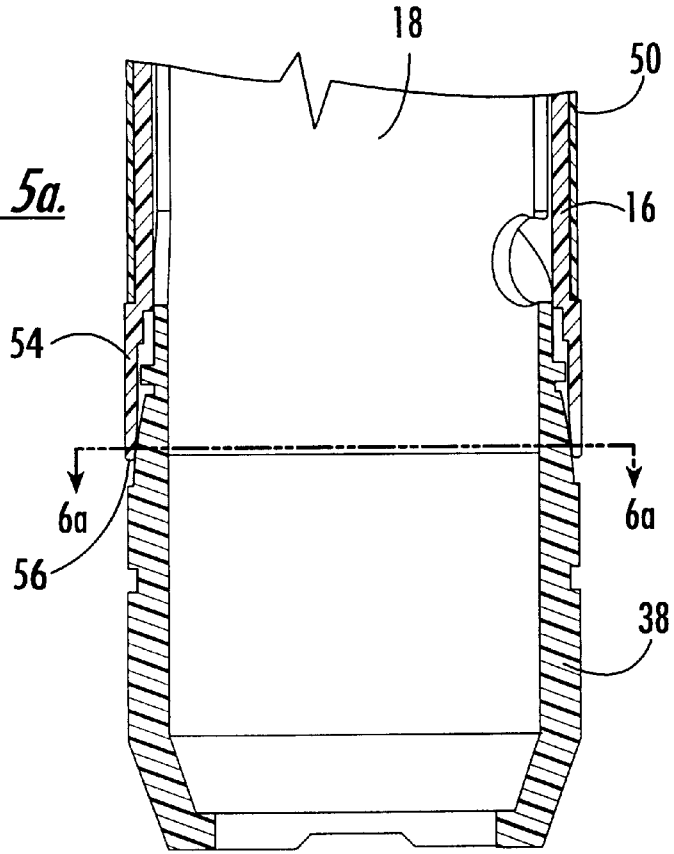
Figure 6B:
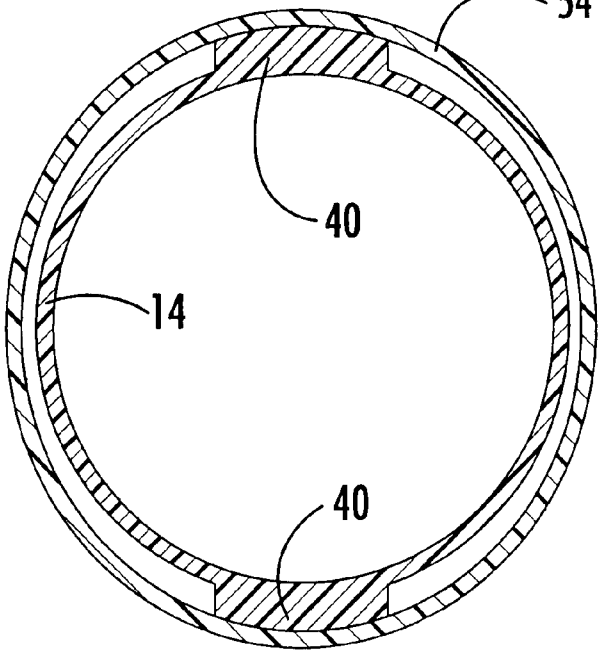
FIG. 6*b* is a cross-sectional view taken substantially along line 6*b* —6*b* of FIG. 5*b*.
Figure 6A:
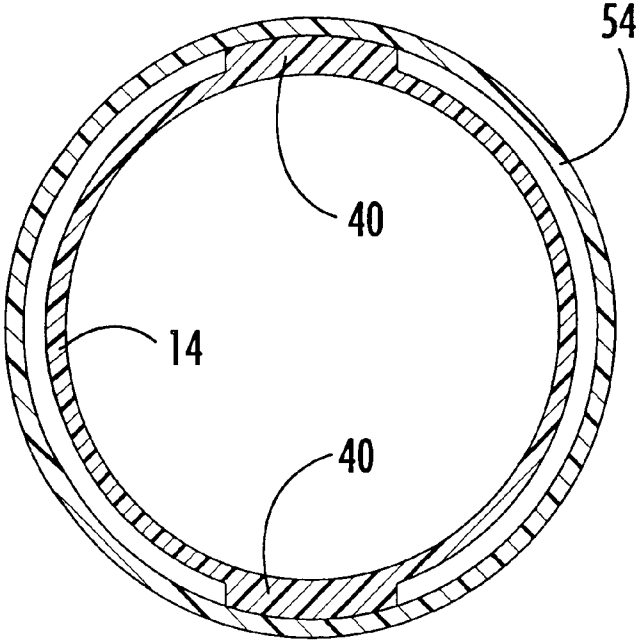
FIG. 6*a* is a cross-sectional view taken substantially along the line 6*a* —6*a* of FIG. 5*a*.

A cylindrical skirt 54 is provided at the lower end of the second sleeve 16 and extends downwardly below the lowermost extent of the helical channels 44. The skirt 54, more particularly, has a reduced wall thickness relative to the wall thickness of the portions of the sleeve 16 where the channel is formed. Consequently, the skirt 54 is resiliently deformable. In the normal or relaxed state, the lowermost edge portion 56 of skirt 54 bears lightly against the inclined ramp surfaces 42 of the protrusions 40 as shown in FIG. 5*a*. Thus in the normal or relaxed state, the skirt 54 has a relaxed, substantially circular configuration as shown in FIG. 6*a*.

However, when a downward axial force is applied to the cosmetic, as occurs during application of the lipstick, the downward axial force is transmitted to the cosmetic carrier 18, and in turn, through the lugs 24, to the cylindrical second sleeve 16. This forces the lowermost edge portions 56 of skirt 54 to bear more tightly against the inclined ramp surfaces 42 and indeed, as a result of manufacturing tolerances, to shift slightly downwardly relative to the inner first sleeve 14 such that the lowermost edge portion 56 bears more tightly against the two diametrically opposed ramp surfaces 42 and actually rides up the inclined surface slightly, as shown in FIG. 5*b*. This causes a deflection of the skirt 54 from the relaxed circular configuration of FIG. 6*a* to a distorted slightly oval configuration as shown in FIG. 6*b*. The resulting frictional engagement between the skirt 54 and the ramp surfaces 42 thereby increases the swivel torque required to cause movement of the cosmetic carrier 18. In this manner, the cosmetic container 10 avoids unwanted push-back of the cosmetic carrier 18 during application of the cosmetic. When downward force is applied to the cosmetic, as shown in FIG. 5*b*, the segmental bead 41 on the side wall 30 of inner sleeve 14 limits the downward movement of the second sleeve 16 relative to the inner sleeve 14 and thus prevents the skirt 54 from being wedged too tightly against the ramp surfaces 42. Under these conditions, as seen from FIG. 5*b*, the bead 41 engages the radially extending internal flange surface which is formed at the juncture between the reduced thickness skirt 54 and the wall of sleeve 16.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A cosmetic container comprising an inner first tubular sleeve having an upper end, a lower end, and a cylindrical side wall extending between said upper and lower ends;

at least one protrusion projecting outwardly from the cylindrical side wall adjacent the lower end of the sleeve;

a cosmetic carrier positioned for movement longitudinally within said first tubular sleeve between an extended upper position and a retracted lower position;

a second tubular sleeve positioned surrounding the first sleeve and rotatable with respect thereto, the second sleeve having helical channel extending along an inner periphery of the sleeve for extending and retracting the cosmetic carrier upon rotation of the first sleeve within the second sleeve; and a resiliently deformable cylindrical skirt on a lower end of said second sleeve extending below said helical channel, said skirt having a lowermost edge portion positioned for bearing lightly against said at least one protrusion when in a relaxed state, and arranged for movement into frictional engagement with said at least one protrusion to deform the skirt from its relaxed state and create a braking force against unwanted retracting movement of the cosmetic carrier when a downward axial force is applied to the cosmetic carrier.

2. A container according to claim 1, wherein said first sleeve includes a plurality of said protrusions at spaced locations around the outer circumference of the sleeve.

3. A container according to claim 2, wherein each said protrusion has a wedge shape configuration defining an inclined ramp surface positioned to frictionally engage a lower edge portion of said skirt.

4. A container according to claim 3, wherein said wedge shaped protrusions are two in number and are located diametrically opposite one another.

5. A container according to claim 1, wherein said first sleeve includes a plurality of said protrusions at spaced locations around the outer circumference of the sleeve, the protrusions being integrally formed with said side wall and projecting radially outwardly therefrom in the form of a wedge configuration to define a ramp surface forming an acute angle with respect to the axis of the sleeve and adapted to frictionally engage a lower edge portion of said skirt.

6. A container according to claim 1, wherein said cylindrical skirt is integrally formed with said second sleeve and has a wall thickness less than that of the second sleeve, wherein said cylindrical skirt is resiliently deformable.

7. A cosmetic container comprising an inner first tubular sleeve having an upper end, a lower end, a cylindrical side wall extending between said upper and lower ends, and a pair of longitudinally extending slots formed in said side wall in diametrically opposed locations;

a plurality of protrusions projecting outwardly from the cylindrical side wall adjacent the lower end of the sleeve;

a cosmetic carrier positioned for movement longitudinally within the first tubular sleeve between an extended upper position and a retracted lower position, said carrier having a pair of lugs extending radially and projecting through the longitudinally extending slots of said first sleeve;

a second tubular sleeve positioned surrounding the first sleeve and rotatable with respect thereto, the second sleeve having helical channel extending along an inner periphery of the sleeve and receiving the lugs of said cosmetic carrier for extending and retracting the cosmetic carrier upon rotation of the first sleeve within the second sleeve; and a resiliently deformable cylindrical skirt on a lower end of said second sleeve extending below said helical channel, said skirt having a lowermost edge portion positioned for bearing lightly against said plurality of protrusions when in a relaxed state, and arranged for movement into frictional engagement with said plurality of protrusions to deform the skirt from its relaxed state and create a braking force against unwanted retracting movement of the cosmetic carrier when a downward axial force is applied to the cosmetic carrier.

8. A container according to claim 7, wherein said first sleeve includes a plurality of said protrusions at spaced locations around the outer circumference of the sleeve, the protrusions being integrally formed with said side wall and projecting radially outwardly therefrom in the form of a wedge to define an inclined ramp surface positioned to frictionally engage a lower edge portion of said skirt.

9. A container according to claim 7, wherein said cylindrical skirt is integrally formed with said second sleeve and has a wall thickness less than that of the second sleeve.

10. A container according to claim 7, including a manually rotatable base at a lower end of the first tubular sleeve, said base having at least a portion thereof with an outer diameter greater than the outer diameter of the cylindrical side wall of the first sleeve, and wherein said protrusions are located at the juncture between said base and the lower end of said cylindrical side wall.

11. A container according to claim 10, wherein said protrusions project radially outwardly a distance not exceeding the outer diameter of the base.

12. A container according to claim 11, additionally including a circumferentially extending bead projecting radially outwardly from said cylindrical side wall adjacent said protrusions.

13. A container according to claim 12, wherein said bead projects radially outwardly a distance less than the maximum outward radial extend of the protrusions and is adapted to engage the inner surface of said second sleeve.

14. A container according to claim 13, wherein said cylindrical skirt is of a reduced wall thickness relative to the wall thickness of adjacent portions of said second sleeve, and a radially extending internal flange surface is formed at the juncture between the reduced thickness skirt and the adjoining wall of sleeve, and wherein said bead is positioned and arranged to engage said radially extending internal flange surface and to thereby limit downward movement of the second sleeve relative to the inner first sleeve.

15. A container according to claim 7, wherein said cylindrical skirt has an outer diameter greater than that of said second tubular sleeve, and additionally including a decorative outermost third sleeve surrounding said second sleeve.

16. A cosmetic container comprising an inner first tubular sleeve having an upper end, a lower end, a cylindrical side wall extending between said upper and lower ends, and a pair of longitudinally extending slots formed in said side wall in diametrically opposed locations;

a pair of wedge shaped protrusions projecting outwardly from the cylindrical side wall adjacent the lower end of the sleeve and defining inclined ramp surfaces;

a cosmetic carrier positioned for movement longitudinally within the first tubular sleeve between an extended upper position and a retracted lower position, said carrier having a pair of lugs extending radially and projecting through the longitudinally extending slots of said first sleeve;

a second tubular sleeve positioned surrounding the first sleeve and rotatable with respect thereto, the second sleeve having helical channel extending along an inner periphery of the sleeve and receiving the lugs of said cosmetic carrier for extending and retracting the cosmetic carrier upon rotation of the first sleeve within the second sleeve; and a resiliently deformable cylindrical skirt on a lower end of said second sleeve extending below said helical channel, said skirt having a lowermost edge portion positioned for bearing lightly against said pair of wedge shaped protrusions when in a relaxed state, and arranged for movement into frictional engagement with said pair of wedge shaped protrusions to deform the skirt from its relaxed state and create a braking force against unwanted retracting movement of the cosmetic carrier when a downward axial force is applied to the cosmetic carrier.

17. A container according to claim 16, wherein said cylindrical skirt is integrally formed with said second sleeve and has a wall thickness less than that of the second sleeve, wherein said cylindrical skirt is resiliently deformable.

* * * * *